US010760758B2

(12) United States Patent
Kauschke

(10) Patent No.: US 10,760,758 B2
(45) Date of Patent: Sep. 1, 2020

(54) HEADLAMP, IN PARTICULAR A HEADLAMP FOR A MOTOR VEHICLE

(71) Applicant: Hella GmbH & Co. KGaA, Lippstadt (DE)

(72) Inventor: Rainer Kauschke, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/329,828

(22) PCT Filed: Sep. 5, 2017

(86) PCT No.: PCT/EP2017/072159

§ 371 (c)(1),
(2) Date: Mar. 1, 2019

(87) PCT Pub. No.: WO2018/046463

PCT Pub. Date: Mar. 15, 2018

(65) Prior Publication Data

US 2019/0226654 A1 Jul. 25, 2019

(30) Foreign Application Priority Data

Sep. 7, 2016 (DE) ..... 10 2016 116 714

(51) Int. Cl.
*F21S 41/14* (2018.01)
*F21S 41/675* (2018.01)
(Continued)

(52) U.S. Cl.
CPC ..... *F21S 41/18* (2018.01); *F21S 41/14* (2018.01); *F21S 41/141* (2018.01); *F21S 41/16* (2018.01);
(Continued)

(58) Field of Classification Search
None
See application file for complete search history.

(56) References Cited

U.S. PATENT DOCUMENTS

2002/0149939 A1 10/2002 Nakagawa et al.
2015/0377430 A1 12/2015 Bhakta
(Continued)

FOREIGN PATENT DOCUMENTS

DE 102014213179 A1 * 1/2015 ..... B60Q 1/143
DE 102014213179 A1 1/2015
DE 102014113700 A1 3/2016

*Primary Examiner* — Britt D Hanley
(74) *Attorney, Agent, or Firm* — Husch Blackwell LLP

(57) ABSTRACT

A headlamp, and in particular a headlamp for a motor vehicle, comprising a digital micromirror device which reflects light hitting it so that it exits at least partially from the headlamp when the headlamp is operated. The headlamp also includes at least one first light source which emits light with a first luminance, and which hits the digital micromirror device at least partially when the headlamp is operated. The headlamp also includes at least one second light source emitting light when the headlamp is operated, and having a second luminance which is different from the first luminance. The light emitted from the at least one second light source hits, at least partially, the digital micromirror device. The areas of incidence of the light emitted by the light sources on the digital micromirror device overlap at least partially. On the digital micromirror device, the range of incidence of the light emitted by the at least one first light source differs from the range of incidence of the light emitted by the at least one second light source.

11 Claims, 8 Drawing Sheets

(51) Int. Cl.

| | |
|---|---|
| ***F21S 41/50*** | (2018.01) |
| ***F21S 41/16*** | (2018.01) |
| ***F21S 41/141*** | (2018.01) |
| ***F21S 41/20*** | (2018.01) |

(52) U.S. Cl.
CPC ..... *F21S 41/285* (2018.01); *F21S 41/50* (2018.01); *F21S 41/675* (2018.01)

(56) References Cited

U.S. PATENT DOCUMENTS

| | | | | |
|---|---|---|---|---|
| 2015/0377442 | A1 | 12/2015 | Bhakta et al. | |
| 2019/0145600 | A1* | 5/2019 | Spinger | F21S 41/675 362/277 |

* cited by examiner

HEADLAMP, IN PARTICULAR A HEADLAMP FOR A MOTOR VEHICLE

CROSS REFERENCE

This application claims priority to PCT Application No. PCT/EP2017/072159, filed Sep. 5, 2017, which itself claims priority to German Patent Application 10 2016 116712.2, filed Sep. 7, 2016, the entirety of both of which are hereby incorporated by reference.

FIELD OF THE INVENTION

The present invention relates to a headlamp and in particular to a headlamp for a motor vehicle.

BACKGROUND

Headlamps with a digital micromirror device or DMD have, as a rule, a lower degree of system efficiency than reflector or projector-type headlamps. An individual laser light source cannot provide the luminous flux for a total light distribution. High-luminance (HL-) LEDs have a high luminous flux, but a relatively low luminance when compared to laser light sources. HL-LEDs are significantly more economic than laser light sources.

Today's headlamps do not have the resolution of DMD-chips in LED matrix systems. Headlamps with LEDs or HL-LEDs do not feature high luminous intensities, or large aperture angle in a DMD light distribution. Despite an increase in light flux of laser light sources for automotive requirements, these are still not sufficient for a total light distribution.

A headlamp of the type mentioned initially is known from US 2015/0377430 A1. This headlamp comprises a DMD chip, a multitude of laser diodes, and at least one blue LED. The laser radiation emitted by the laser diodes is focused onto converter means which transform the laser radiation at least partially into yellow light. This yellow light is projected to the surface of the DMD chip by means of a dichroitic mirror. Herein, the active surface of the DMD chip is fully illuminated by this light of the laser light source. Likewise is the light of the blue LED projected to the entire active surface of the DMD chip by means of the dichroitic mirror. The light from the DMD chip is a mixture of the blue and the yellow light, so that the light emitted by the headlamp is white.

SUMMARY OF THE INVENTION

The problem the present invention seeks to solve is the creation of a headlamp of the type described above, which can effectively generate an inhomogeneous light distribution from light sources with differing luminance.

It is provided that on the digital micromirror device, the range of incidence of the light emitted by the, at least one, first light source is different from the range of incidence of the light emitted by the, at least one, second light source. Herein, the invention comprises such embodiments, in which the areas of incidence do not overlap. However, also such embodiments are comprised, in which the areas of incidents have at least one overlapping area.

The areas of incidence may for example be different in size. In practice, the range of incidence of the light emitted by the, at least one, light source on the digital micromirror device can be larger than, and in particular be at least twice the size as, the range of incidence of the light emitted by the, at least one, second light source, wherein the range of incidence of the light emitted by the, at least one, second light source is preferably at least partially surrounded by the light emitted by the, at least one, first light source. By differing areas of incidence of the light emitted by the individual light sources, it can be combined in a suitable manner.

It can be planned, that the light emitted by the, at least one, first light source contributes to a different light function of the headlamp than the light emitted by the, at least one, second light source. Typical light functions are for example a dazzle-free high beam; a building site light; light contributing to augmented reality; navigating or traffic control light; the representation of markings, danger signs, and deviations by means of light; visualizations and representations for autonomous driving; the use of light for lane detection, and for optical guidance as well as welcome-light, leaving-home-light and for light used for animation or entertainment.

It can be planned that the, at least one, light source comprises at least one light emitting diode, and in particular at least one HL-LED. Furthermore it can be provided, that the, at least one, second light source comprises at least one laser diode and converter means converting the light emitted by the, at least one, laser diode into the light emitted by the light source. Herein the, at least one, first light source and the, at least one, second light source can be embodied so that they emit white light when the headlamp is operated. By combining light emitting diodes and laser diodes for an inhomogeneous illumination of the DMD chip, the light functions of the headlamp can be generated more effectively. A central illumination of the DMD chip or an illumination slightly above the center with the light of the, at least one, laser diode can for example provide a high luminous intensity in HV (vanishing point at infinity) resp. for the high beam light distribution. At the same time, a full illumination of the DMD chip with the light of the, at least one, light diode, which normally has a distinctly lower luminance than the light of a laser diode, can for example, realize a wide illumination in the area in front of the vehicle not exceeding the legal maximum values for light distribution.

It is possible, that the headlamp comprises first optic means for the application of the light emitted by the, at least one, first light source onto the digital micromirror device and/or second optic means for the application of the light emitted by the, at least one, second light source, wherein the first and the second optic means are preferably different from one another. By this means, the inhomogeneous illumination of the surface of the digital micromirror device can be improved with the light of the different light sources, because each of the optic means can be adapted to the properties of the light to be applied.

It can be planned that the headlamp comprises separating means separating the light emitted by the, at least one, first light source from that of the, at least one, second light source in the area of the first and/or second optic means, i.e. before the light hits the digital micromirror device. This can for example be useful to prevent the light of the, at least one, first light diode from hitting the converter means of the, at least one, second light source, or prevent the light emitted by one of the light sources from passing the optic means optimized for the light of the other light sources.

It is possible that the headlamp comprises third optic means, which are arranged in the beam path between the digital micromirror device and an light exit aperture of the headlamp, wherein the light of the, at least one, first light source as well as the light of the, at least one, second light source is coupled out of the headlamp by the third optic means. By a joint exit of light emitted by the at least two light sources from third optic means, an identical visual appearance is created for the different types of light.

It can be planned, that the, at least one, first light source and the, at least one, second light source are arranged on a common holder, wherein the light sources are preferably arranged on a common heatsink. Thereby, the headlamp can have a very compact design.

Preferred embodiments of the invention can feature further advantages. For example, at least one laser light source combined with at least one High-Luminance-LED light source (for short: HL-LED light source) can serve as a light source with little étendue for a headlamp provided with a DMD chip. The light of, for example, two laser light sources can be bundled slightly above HV to ensure the large reach of a laser light distribution. A DMD chip can make the resolution of a HD-matrix system possible.

In an exemplary manner, a HL-LED light distribution can always be activated, in particular also with headlamp flashers, low beam, and city traffic, as lower luminance values are sufficient here. Furthermore, it can be tried to achieve a cost optimum by using a minimal number of lasers, a high luminous flux of the HL-LED, and directed illumination with for example a declining plateau distribution or a Gaussian-style light distribution.

It is possible to reduce thermal losses on the digital micromirror device and/or an absorber of the digital micromirror device as the light distribution hitting the DMD chip can have a strong lateral and vertical gradient. This increases the overall degree of efficiency of the system.

An additional lateral lining with an LED reflection- or projection system for a variable and/or homogeneous illumination of the area in front of or on the side of the vehicle can be provided. Where appropriate, this can be sequentially dimmed-up for a quasi-dynamic swiveling of the headlamp.

It may be provided, that a shift of focus is possible in the DMD chip, wherein the full luminous flux is not always given in all areas of the DMD light distribution.

It is possible to provide merely a small third optic, in an exemplary manner mainly rectangular, serving as DMD optic for coupling out, because the high luminance of the laser diode fulfils the étendue-requirements of the DMD chip and allows minimal luminous flux losses in the optic chain (coupling-in of light/DMD chip/optic for coupling-out). An optional field lens can project the entrance opening onto the exit opening of the optic.

Preferred embodiments of the invention can feature further advantages, such as lower overall costs due to HL-LED with long reach of the light distribution and/or laser-boost with high resolution and high contrast, featuring relatively low laser operating times and redundancy due to, for example, two laser light sources. A further advantage can be the combination of the long laser reach of the illumination due to the high laser luminance with the high luminous flux packages of an LED light source for an increased luminous intensity level of the overall light distribution, while at the same time very compact dimensions of the optical system can be achieved. Furthermore, it can be advantageous, that minimal thermal and luminous flux losses are achieved by a systematic asymmetrically adapted distribution of the coupled-in light with vertical and horizontal gradients, wherein even for a high beam, less luminous flux needs to be directed onto the absorber.

DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

In the figures, identical or functionally identical parts have the same reference signs.

Figure 1:
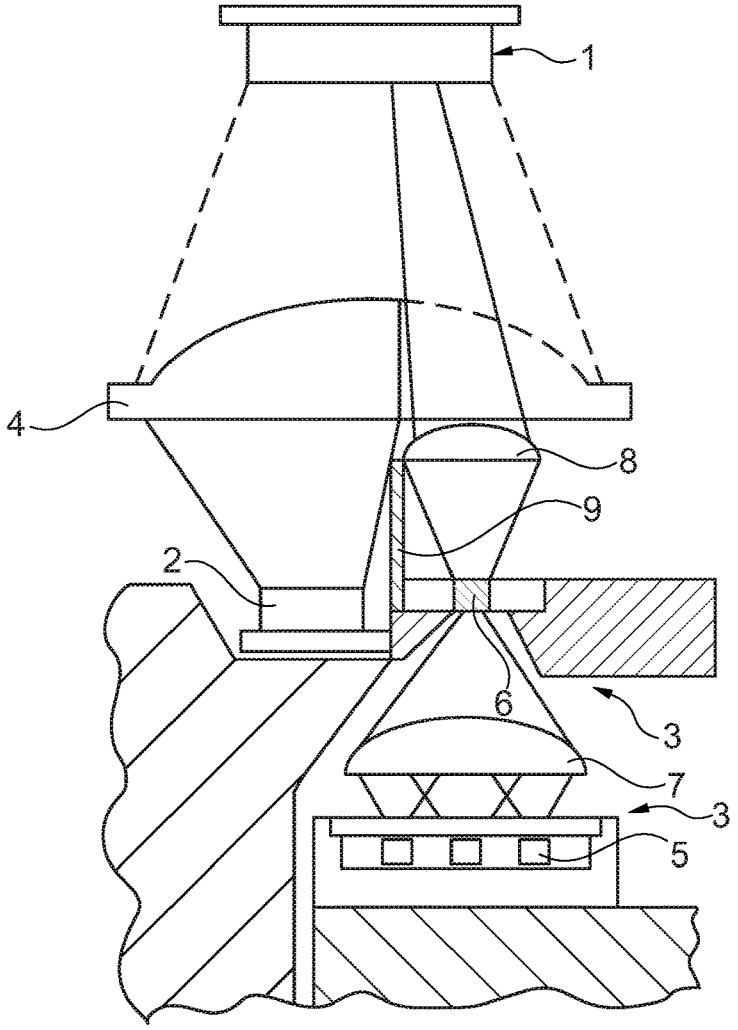
FIG. 1 is a schematic lateral view of a detail of an embodiment of a headlamp according to the invention.
Figure 2:
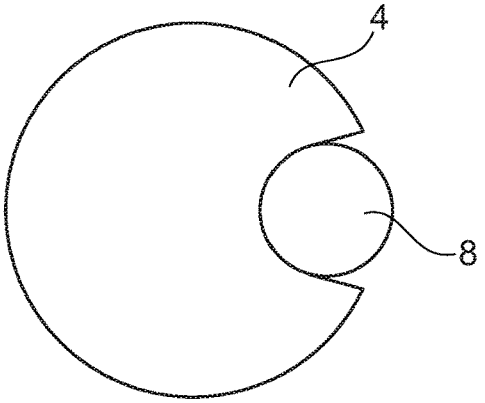
FIG. 2 is a schematic section through the embodiment according to FIG. 1 in the region of optic means of the light sources of the headlamp.

The embodiment of a headlamp according to the invention shown in FIG. 1 and FIG. 2 comprises a digital micromirror device 1, which is in particular embodied as a DMD chip. The embodiment comprises, furthermore, at least one first light source 2 and at least one second light source 3.

In a known manner, the DMD chip comprises a multitude of mirrors which can be individually controlled and tilted, which are not represented. Herein the light hitting the mirrors is reflected so that, in a first position of the respective mirror, the light leaves the headlamp. Each of the mirrors can be moved into a second position called "dark light position", in which the light hitting the mirror is reflected into an absorber—which is not represented—so that it does not leave the headlamp.

The, at least one, first light source 2 is embodied as a light emitting diode (LED), in particular as an HL-LED (High Luminance LED), or as an LED array, or as an LED matrix. First optic means 4, for example in the shape of the represented plano-concave lens are assigned to the first light source 2. The first optic means 4 represent the exit surface of the first light source on the DMD chip.

The, at least one, second light source 3 comprises one or several laser diodes 5 and converter means 6 which transform the light emitted from the, at least one, laser diode 5, in particular into white light. FIG. 1 shows in an exemplary manner a lens 7 focussing the light of the, at least one, laser light diode 5 onto the converter means 6. There are, furthermore, second optic means 8 provided, for example in the shape of the represented plano-convex lens. The second optic means 8 project the exit surface of the converter means 6 of the second light source 3 on the DMD chip.

Herein the exit surface of the converter means 6 is essentially as far away from the DMD chip as the exit surface of the first light source 2. The converter means 6 can be arranged in the vicinity of the light exit surface of the first light source 2 or at a distance from it, as separate beam paths are required for the second light source 2 and the converter means 6. To this end, the embodiment represented in FIG. 1 has lightproof separating means 9, which are in particular arranged between the first light source 2 and the converter means 6.

The reproduction scale of the first optic means 4 assigned to the first light source 2 can be between 1:1 and 1:20. The reproduction scale of the second optic means 8 assigned to the second light source 3 can be between 1:2 and 1:10.

FIG. 2 shows, that the first and the second optic means 4, 8 partially enter in one another's ranges. In particular, the second optical means 8 assigned to the second light source 3 are arranged in an edge region of the first optical means 4 assigned to the first light source 2. In particular, the first optical means 4 have a recess in this edge region.

The light of the first light source 2 is projected onto the digital micromirror device embodied as a DMD chip in such a way that the DMD chip surface is fully illuminated with this light. The range of incidence 10 of the light emitted by the first light source 2 thus corresponds essentially to the complete active surface of the DMD chip (see also FIG. 4). The light of the second light source 3, in contrast, is projected onto the digital micromirror device embodied as a DMD chip in such a manner that the DMD chip is, for example, illuminated with this light in a central area only. The range of incidence 11 of the light emitted by the second light source 3 is thus significantly smaller than the range of incidence of the light emitted by the first light source 2 (see also FIG. 4.).

The range of incidence 11 of the light emitted by the second light source 3 is preferably located in the center or close to the center of the DMD chip or predominantly in the center of the upper or lower edge of the DMD chip if the DMD chip is only used for a HD far range illumination (high beam) or only for a HD illumination directly in front of the vehicle. If both far range lighting and lighting directly in front of the vehicle are covered by the DMD chip, the maximum of the laser light distribution in the central third of the DMD chip can be placed predominantly in the middle.

In the embodiment shown in FIG. 1, the converter means 6 are embodied as a transmission conversion ceramic, wherein the, at least one, laser diode is for example embodied as a blue single laser with an emission wavelength of 450 nm or 405 nm. The transmission conversion ceramic converts a part of the blue laser radiation into yellow light, disperses the blue laser light, and creates an overall impression of a white laser color. A successful heat dissipation of the ceramic is achieved by a suitable thermomechanical design of the luminous ceramic environment, featuring high reliability of the ceramic system.

It is possible to use a laser diode bar, a stack of laser diode bars or a laser matrix instead of the, at least one, single laser, wherein each of the emitters projects these laser light sources with a micro lens onto a focal point in which or near which the converter means 6 are arranged. The required number of micro lenses is schematically indicated in FIG. 1 by the plano-convex lens 7.

The combination of at least one light diode and at least one laser light source allows the advantages of the two light sources to be combined while optimizing the cost of the overall system. The, at least one, LED features a high luminous flux, low costs and a long service life. The, at least one, laser diode features high luminance at higher costs and small dimensions of the light exit surface, for example the converter means. In addition, the chromaticity color coordinates of the light from the light emitting diode which is for example embodied as an HL-LED, the light from the, at least one, laser diode and the light from any other LED light sources of the headlamp are superimposed.

With laser light sources, there is a so-called COD risk (catastrophic optical damage) caused by the optically induced destruction of a laser diode. This risk is high with a laser light source, so that usually a redundancy is created by the use of several laser light sources. Due to the combination of at least one laser light source with at least one laser light source preferably provided for within the scope of this invention, the, at least one, light diode can serve as a backup even in the event of a COD failure of a laser diode and continue to permit safe driving (failsafe condition).

Due to the larger dimensions of the light exit surface of the, at least one, light emitting diode, there may be a certain amount of lateral or top/bottom radiation beyond the DMD chip. The DMD chip is an étendue-limited component which is dependent on a small beam divergence with regard to the coupling-in of light and thus also to the coupling-out of light. The laser light source and the preferably provided combination of at least one light emitting diode with at least one laser light source within the framework of the present invention are very suitable for this optical requirement. The coupling-in is advantageously carried out vertically from below or laterally at an angle from below, depending on the type and tilting axis of the digital micromirror.

Figure 3:
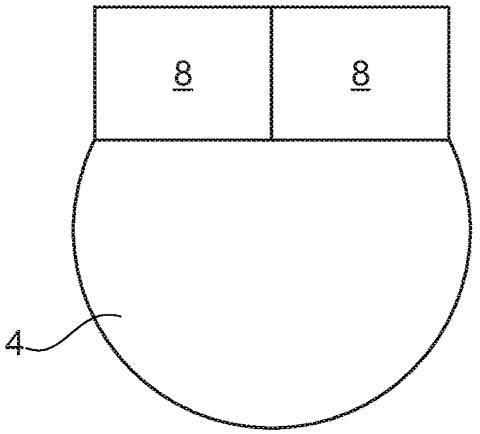
FIG. 3 is a schematic section corresponding to FIG. 2 through a further embodiment of a headlamp according to the invention.

FIG. 3 shows an embodiment in which two laser-boost light sources serving as second light sources with two assigned second optical means 8 are provided. Furthermore, a first light source 2 embodied as a light emitting diode (LED), and in particular an HL-LED, is provided with an assigned optic means 4, as in the first embodiment. In this embodiment, the HL-LED is partially also used for the lighting directly in front of the vehicle. To this end, the DMD chip provides an "environment mirroring", which is similar in effect to the performance light setting of the DMD mirrors. In the "dark light position" the light hitting the DMD micromirror is directed to an absorber.

Each of the light sources (laser boost or HL-LED) is assigned optical means 4, 8, because the light sources are arranged at a distance from each other and their images are to be superimposed on the DMD chip to form the desired light distribution. As an inhomogeneous light distribution is aimed at, it can be achieved by this means that as little light as possible needs to be directed to the absorber. In addition, this inhomogeneous light distribution on the DMD chip is due to the requirements of a headlamp which requires high luminous intensities in HV (vanishing point at infinity), i.e. for high beam light distribution, but at the same time can be operated with significantly lower luminous intensities directly in front of the vehicle, as the legal maximum values for headlamp light distribution must not be exceeded here.

Figure 4:
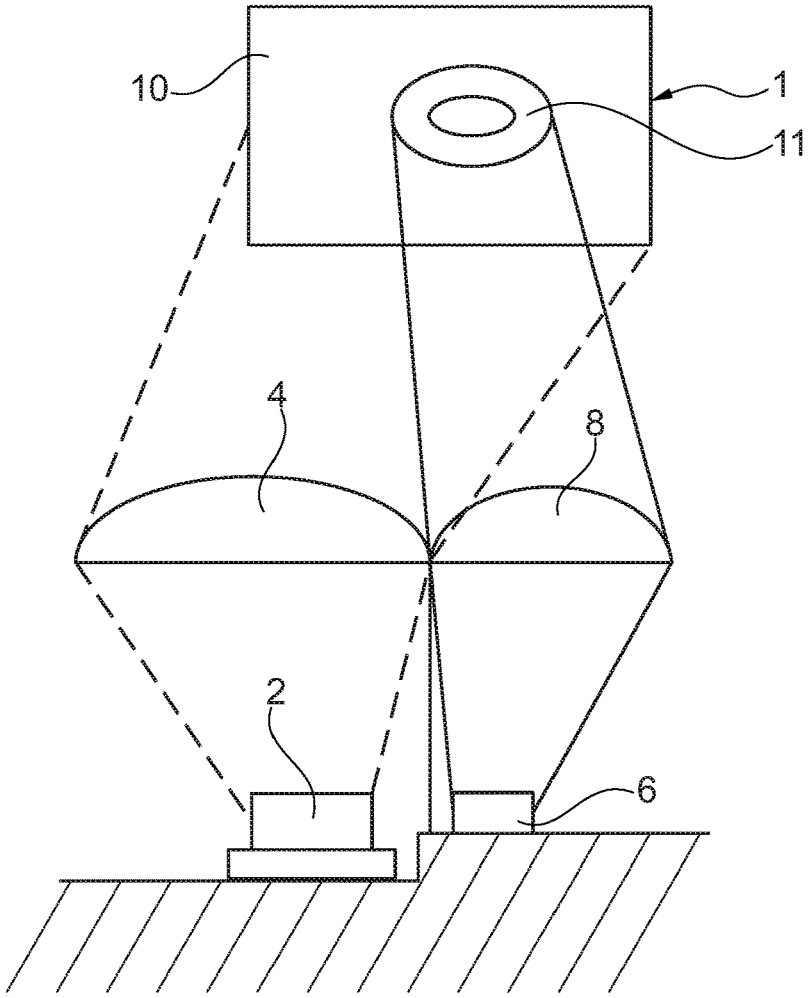
FIG. 4 is a schematic lateral view of a detail of a further embodiment of a headlamp according to the invention.

In the embodiment represented in FIG. 4, the converter means 6 are embodied as reflection-conversion ceramics. The converter means 6 are arranged next to the first light source 2 embodied as HL-LED; they carry out a partial conversion of the blue laser radiation into yellow light and then create a white color impression from reflected and scattered blue laser light and partially converted yellow light. The white color impression should be produced over a medium angle range for the illumination.

The converter means 6, which are designed as reflection-conversion ceramics, are reliably attached to heat dissipation elements below by means of a suitable layer structure that conforms to thermal expansion. The blue laser beam is directed at the ceramic from above at an angle between 15° and 88° to the ceramic normal, grazing it sideways. Herein, the blue laser light can originate from at least one laser light source, in particular at least one individual laser diode, a laser diode bar, a stack of laser diode bars, a laser array or a laser matrix, and is directed by suitable optic means such as lenses and/or reflectors and/or prisms or the like to a focal point located on the reflection-conversion ceramic.

Figure 5:
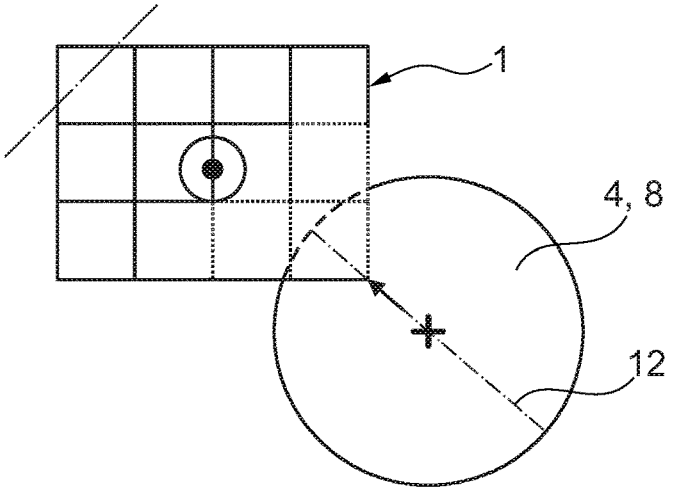
FIG. 5 is a schematic view of an embodiment of a digital micromirror device of a headlamp according to the invention.
Figure 6:
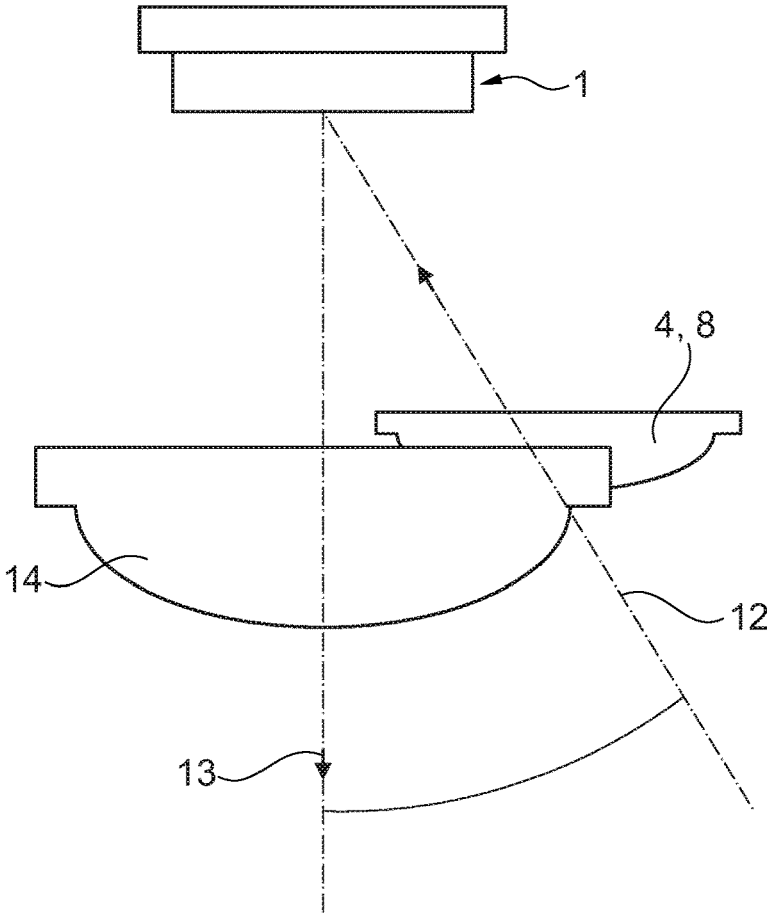
FIG. 6 is a schematic illustration of the beam path in the region of the digital micromirror device according to FIG. 5.

FIG. 5 and FIG. 6 illustrate the impact and the reflection of light on a micromirror device 1 having diagonally arranged micro-swivel-axes. Herein, FIG. 5 shows that the light 12 incident on the DMD chip hits the DMD chip laterally at an angle from below and passes, for example, through the first and/or second optical means 4, 8. In addition to the light 12 incident on the micromirror device 1, FIG. 6 also shows the light 13 reflected by the micromirror device 1 which runs downward in FIG. 6. Furthermore, FIG. 6 shows in an exemplary manner the first and/or second optical means 4, 8 assigned to the first and/or second light source and the schematically indicated third optical means 14 through which the reflected light 13 passes before leaving the headlamp.

Figure 7:
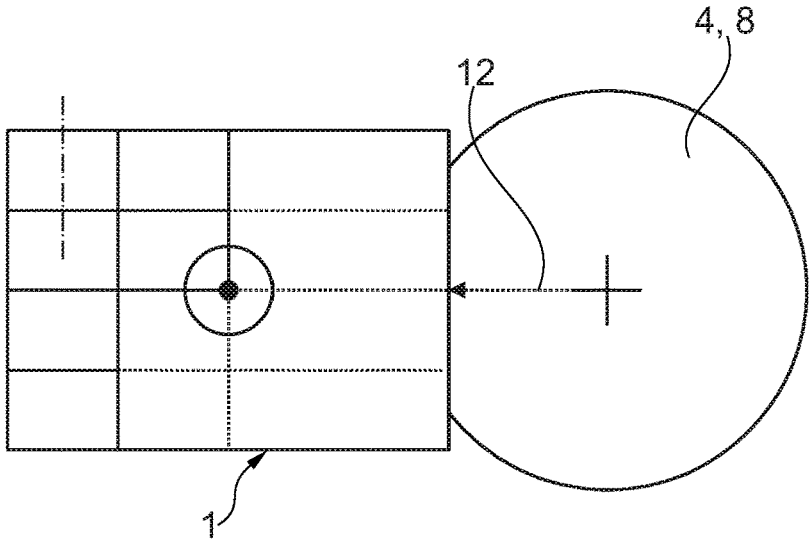
FIG. 7 is a schematic view of a further embodiment of a digital microprocessor device of a headlamp according to the invention.

FIG. 7 shows a micromirror device 1 having vertically arranged swivel axes and square, rectangular, diamond or parallelogram-shaped micro-mirrors. Accordingly, the first and/or second optic means 4, 8 used for the coupling-in of the light are positioned laterally. A respective arrangement would be given if the optical means were arranged below the DMD chip and the swivel axes of the micromirror array then run horizontally.

Figure 8:
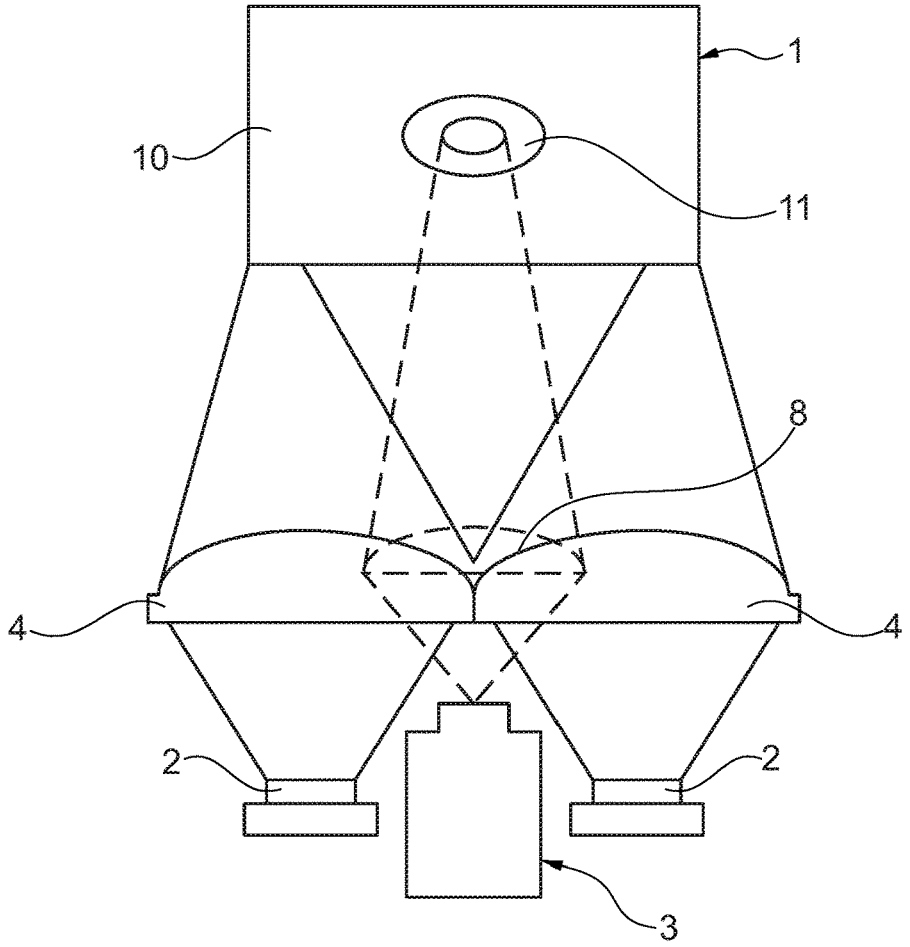
FIG. 8 is a schematic lateral view of a detail of a further embodiment of a headlamp according to the invention.
Figure 9:
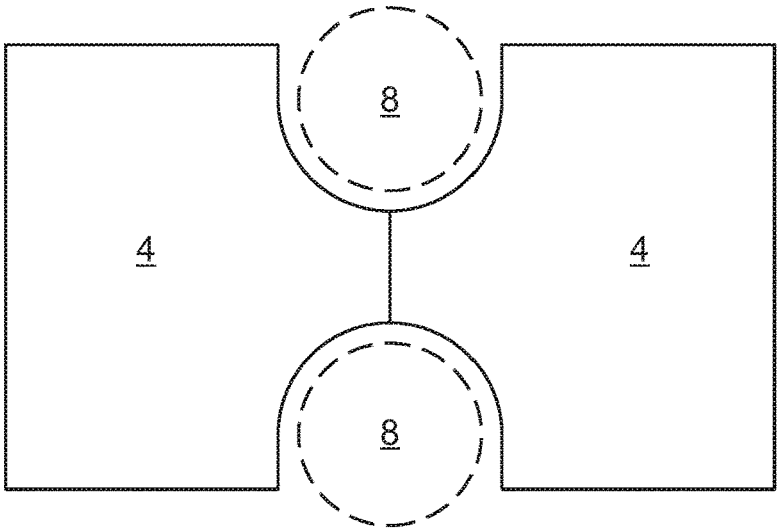
FIG. 9 is a schematic sections through the embodiment according to FIG. 8 in the region of optic means of the light sources of the headlamp.

In the embodiment shown in FIG. 8 and FIG. 9, two first light sources 2 and two second light sources 3 are provided. Herein, as with other embodiments, the first light sources 2 can comprise at least one light emitting diode each and the second light sources 3 at least one laser diode each.

The two second light sources 3 are arranged in the middle and generate a more or less extended area of incidence 11, embodied as a hotspot, in the middle of the DMD chip (here tilted into the plane of representation for better visualization). The area of incidence 11 can be embodied in a round or elliptical or triangular or trapezoidal shape. FIG. 9 illustrates the respective arrangement of the assigned first and second optic means 4, 8.

Figure 10:
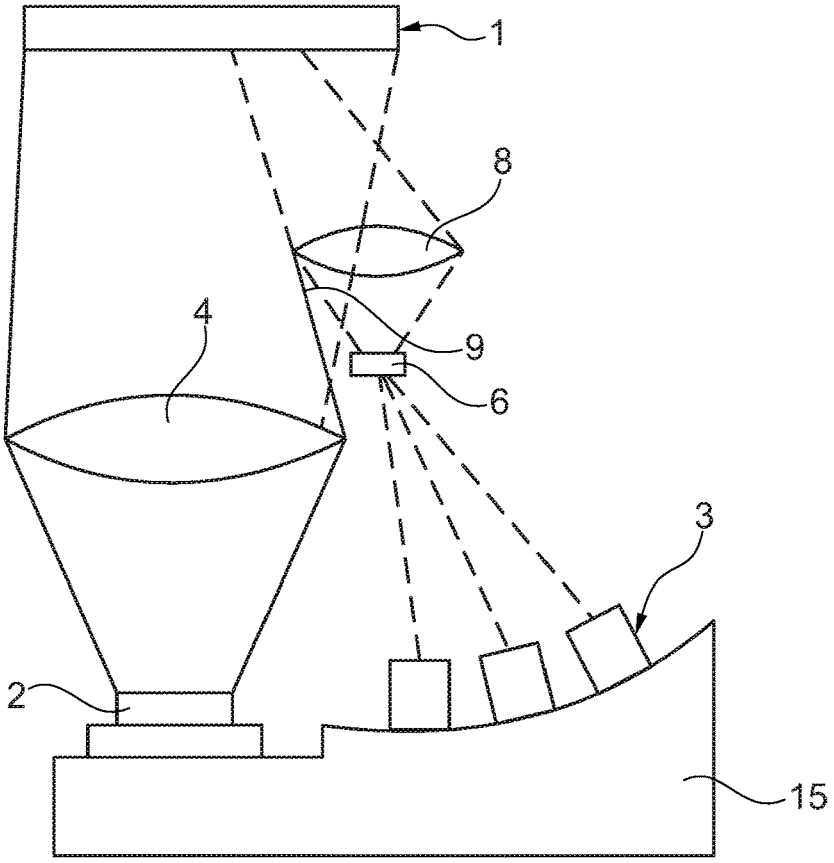
FIG. 10 is a schematic lateral view of a detail of a further embodiment of a headlamp according to the invention.

FIG. 10 shows an embodiment in which the distance between the converter means designed as a transmission-conversion ceramic and the DMD chip area is considerably smaller than in the embodiment according to FIG. 1. The projection of the laser radiation emitted by the, at least one, second light source 3 is performed shielded by means of separating means 9 with assigned second optical means 8, for example embodied as a biconvex lens.

In this embodiment, the transmission-conversion ceramic is irradiated with three or eight laser diodes respectively, which are arranged on a common heat sink 15 together with the first light source 2 embodied as an HL-LED. The HL-LED also has its own first optical means 4, which project the light emitted by the HL-LED onto the entire DMD chip. Herein, partial shading takes place through the coupled-in laser beam path, which is acceptable because the second headlight of the vehicle in particular superimposes the partial shading area.

Figure 11:
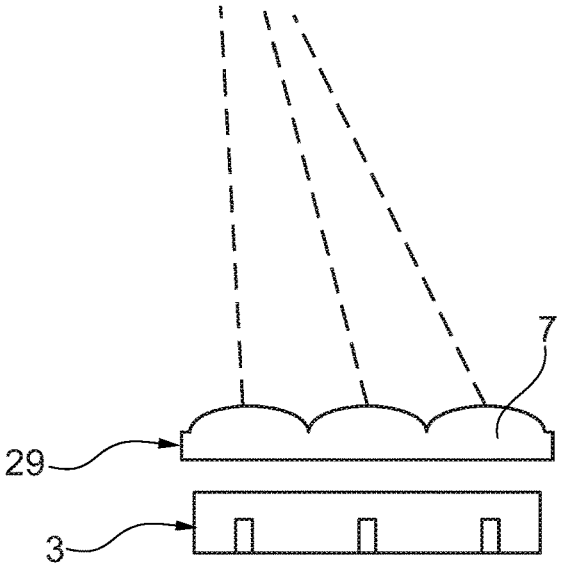
FIG. 11 is a schematic detailed view of an alternative light source for the embodiment according to FIG. 10.

FIG. 11 shows a detail of an embodiment of a headlamp, in which at least one second light source 3 is embodied as a laser array or as a laser diode bar. Herein, each emitter of the semiconductor laser has a lens 7 or a lens array 29 assigned, wherein the optical axes of the lenses 7 preferably intersect in a focal point, which is in particular arranged in the region of the converter means.

The headlamp according to the invention can be controlled by high-definition matrix electronics, whereby other road users, in particular those driving in front or oncoming road users, are detected by camera or other sensor systems. The light distribution generated by the headlamp can be used for traffic situations, topology, weather conditions, customer requirements, navigation instructions such as head-up display equivalents for night driving, as well as for construction site lighting, where the width of the vehicle is visualized to the driver, or used for communication purposes. Herein, autonomous and automatic driving conditions are possible. Furthermore, avoidance routes can be visualized for the driver and other road users. Also, marked light or high-definition glare-free matrix high beam is possible.

Figure 12:
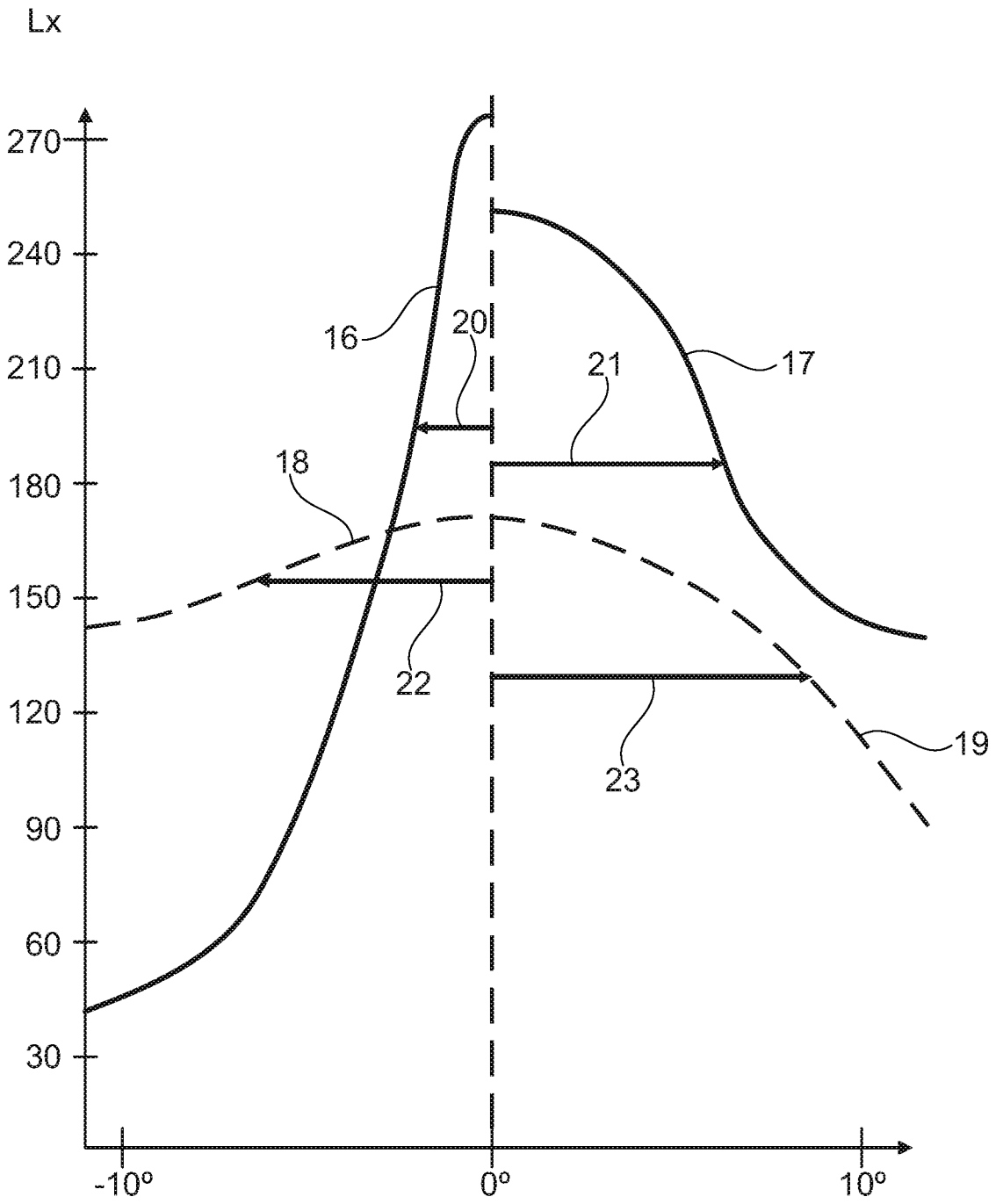
FIG. 12 is a diagram in which one schematic horizontal section each is indicated for four different high beam light distributions, that can be generated with an embodiment of a headlamp according to the invention, wherein the illuminance in Lx is applied at a distance of 25 m from the headlamp against the horizontal angle of deflection.

In FIG. 12, four different high beam light distributions are indicated with an embodiment of a headlamp according to the invention. Herein, each of the indicated horizontal sections 16, 17, 18, 19 of the high beam light distributions is indicated either for positive or for negative angles only. Each horizontal section 16, 17, 18, 19 of the high beam light distributions is to be continued in a mirror-inverted manner on the other side of the 0°-line.

The high beam light distribution illustrated by the horizontal section 16 shows essentially the maximum permissible illuminance according to the ECE directives. Here, the high beam light distribution is focused on the middle of the driving lane, with a FWHM (Full Width Half Maximum) being removed from the 0°-line by merely about 2° (see arrow 20).

The high beam light distribution illustrated by the horizontal section 17 also shows essentially the maximum permissible illuminance according to the ECE directives. Here however, the high beam light distribution is clearly wider, with a FWHM (Full Width Half Maximum) being removed from the 0°-line by about 6° (see arrow 21).

The high beam light distribution illustrated by the horizontal section 18 shows essentially a minimally required illuminance. Herein, the high beam light distribution is relatively narrow with a FWHM (Full Width Half Maximum) being removed from the 0°-line by merely about 4° (see arrow 22).

The high beam light distribution illustrated by the horizontal section 19 also shows essentially a minimally required illuminance. Herein, the high beam light distribution is relatively wide with a FWHM (Full Width Half Maximum) being removed from the 0°-line by about 8° (see arrow 23).

Figure 13:
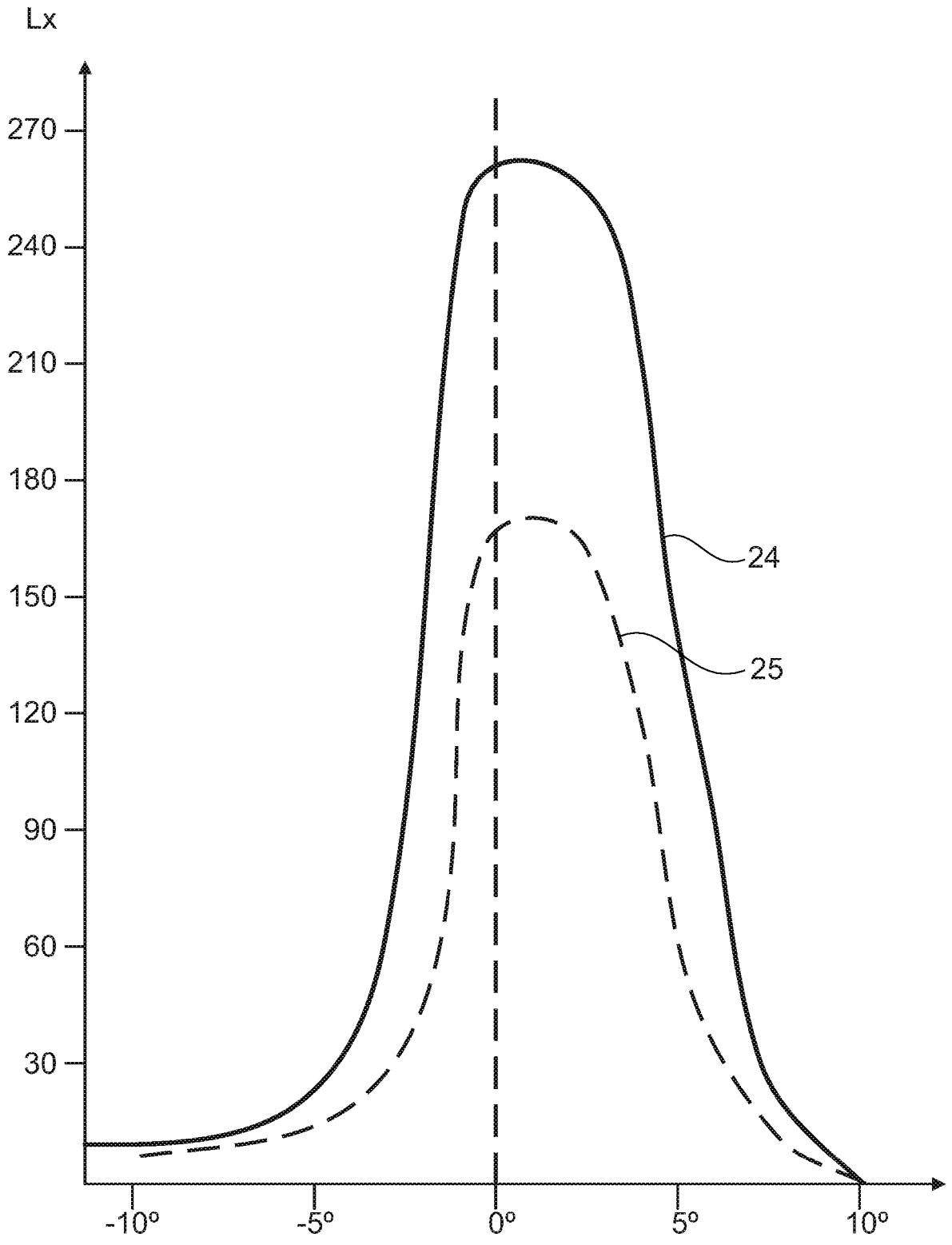
FIG. 13 is a diagram in which one schematic vertical section each is indicated for two different high beam light distributions, that can be generated with an embodiment of a headlamp according to the invention, wherein the illuminance in Lx is applied at a distance of 25 m from the headlamp against the vertical angle of deflection.

FIG. 13 indicates two different high beam light distributions which can be generated with a headlamp according to the invention. The high beam light distribution illustrated by the vertical section 24 has essentially the maximum permissible illuminance according to the ECE directives. It extends across a large angular range in the vertical direction, so that objects situated clearly above the road surface are also illuminated.

The high beam light distribution illustrated by means of the vertical section 25, in contrast, has essentially a minimally required illuminance. It extends in the vertical direction across a smaller angular range.

Figure 14:
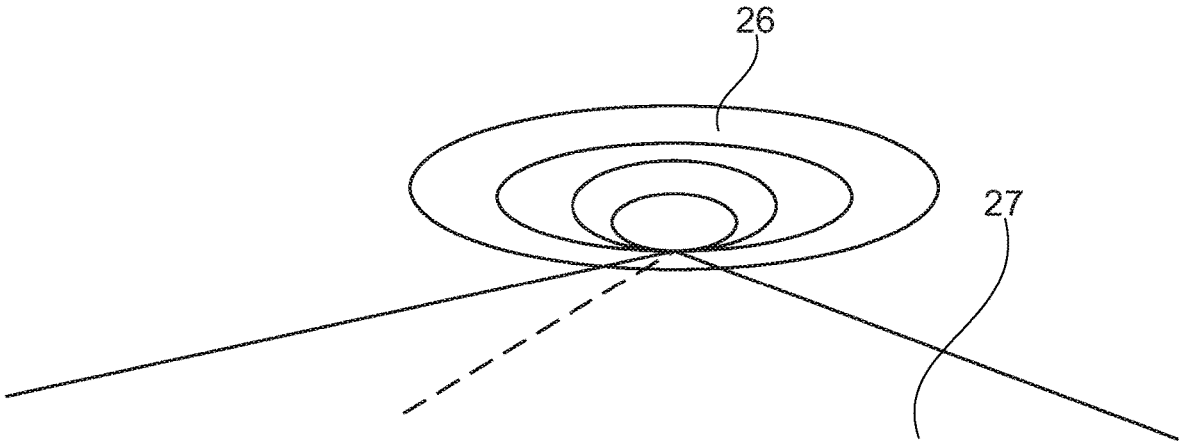
FIG. 14 is a first high beam light distribution with can be generated with a headlamp according to the invention, on a schematically indicated road.
Figure 15:
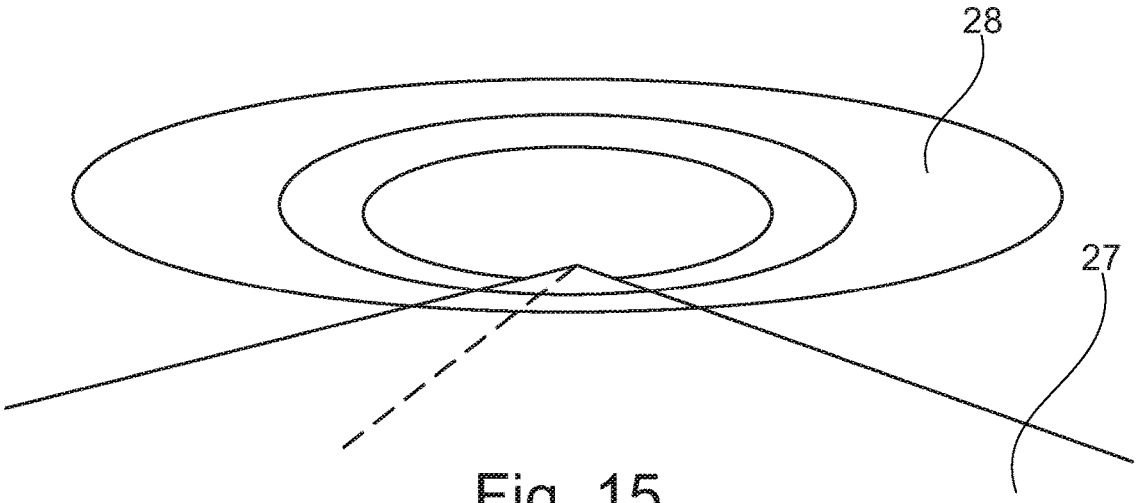
FIG. 15 is a second high beam light distribution with can be generated with a headlamp according to the invention, on a schematically indicated road.

FIG. 14 shows the light distribution 26, which can be generated by an embodiment of a headlamp according to the invention, on a schematically indicated road 27 relatively focused in the middle of the driving lane. The light distribution 28 indicated in FIG. 15, in contrast, is relatively wide, and illuminates also areas next to the road.

1 Digital micromirror device
2 First light source
3 Second light source
4 First optic means
5 Laser diode
6 Converter means
7 Lens
8 Second optic means
9 Separating means
10 Area of incidence of the light emitted by the first light source 2
11 Area of incidence of the light emitted by the second light source 3
12 Light hitting the micromirror device 1
13 Light reflected by the micromirror device 1
14 Third optic means
15 Heatsink
16 Horizontal section of a high beam light distribution
17 Horizontal section of a high beam light distribution
18 Horizontal section of a high beam light distribution
19 Horizontal section of a high beam light distribution
20 Arrow indicating the FWHM
21 Arrow indicating the FWHM
22 Arrow indicating the FWHM
23 Arrow indicating the FWHM
24 Vertical section of a high beam light distribution
25 Vertical section of a high beam light distribution
26 High beam light distribution
27 Road
28 High beam light distribution
29 Lens array

The invention claimed is:

1. A headlamp for a motor vehicle, the headlamp comprising a digital micromirror device which reflects light hitting it so that the light exits at least partially from the headlamp when the headlamp is operated;

at least one first light source which emits light with a first luminance, wherein said light with the first luminance hits the digital micromirror device at least partially when the headlamp is operated;

at least one second light source emitting light when the headlamp is operated, the light emitted by the second light source having a second luminance which is different from the first luminance, wherein the light emitted from the at least one second light source hits, at least partially, the digital micromirror device;

wherein areas of incidence of the light emitted by the light sources on the digital micromirror device overlap at least partially;

wherein on the digital micromirror device, a range of incidence of the light emitted by the at least one first light source differs from a range of incidence of the light emitted by the, at least one second light source;

wherein the headlamp comprises first optic means for the application of the light emitted by the at least one first light source onto the digital micromirror device and/or second optic means for the application of the light emitted by the at least one second light source onto the digital micromirror device, wherein the first and the second optic means are preferably different from one another, and wherein one of the first and second optic means is a plano-concave lens.

2. The headlamp according to claim 1, wherein on the digital micromirror device, the range of incidence of the light emitted by the at least one first light source is larger than the range of incidence of the light emitted by the at least one second light source, wherein the range of incidence of the light emitted by the at least one second light source is at least partially surrounded by the range of incidence of the light emitted by the at least one light source.

3. The headlamp according to claim 1 wherein the light emitted by the at least one first light source contributes to a light function of the headlamp which is different from a light function to which the light emitted by the at least one second light source contributes.

4. The headlamp according to claim 1 wherein the at least one first light source comprises at least one light emitting diode.

5. The headlamp according to claim 1 wherein the at least one second light source comprises at least one laser diode, and converter means which convert the light emitted by the at least one laser diode into the light emitted by the light source.

6. The headlamp according to claim 5, wherein the conversion is executed by the converter means by means of transmission or reflection.

7. The headlamp according to claim 1 wherein one of the at least one first light source and the at least one second light source are embodied so that they emit white light when the headlamp is operated.

8. The headlamp according to claim 1 wherein the headlamp comprises separating means which separate the light emitted by the at least one first light source from the light emitted by the at least one second light source in the area of the first and/or second optic means, and/or before the hitting of the digital micromirror device.

9. The headlamp according to claim 1 wherein the headlamp comprises third optic means, which are arranged in the beam path between the digital micromirror device and a light exit aperture of the headlamp, wherein the light emitted by the at least one first light source as well as the light emitted by the at least one second light source is coupled out of the headlamp by the third optic means.

10. The headlamp according to claim 1 wherein the first and second optic means of the headlamp at least partially overlap.

11. The headlamp according to claim 1 wherein the first light source and the second light source each comprise two light sources.

* * * * *